United States Patent [19]

Carlson, Jr. et al.

[11] Patent Number: 4,599,926

[45] Date of Patent: Jul. 15, 1986

[54] ROTARY CUTTING DIES WITH VACUUM ASSIST TO CUT AND CLEAR WASTE

[75] Inventors: Leroy H. Carlson, Jr., East Hartford; Martin Kesten, West Hartford, both of Conn.

[73] Assignee: Preston Engravers, Inc., Windsor, Conn.

[21] Appl. No.: 631,193

[22] Filed: Jul. 16, 1984

[51] Int. Cl.[4] ..... B26D 7/18

[52] U.S. Cl. ..... 83/100; 83/690

[58] Field of Search ..... 83/98, 100, 152, 690

[56] References Cited

U.S. PATENT DOCUMENTS

| | | | |
|---|---|---|---|
| 1,825,250 | 9/1931 | Rehak | 83/100 |
| 2,463,455 | 3/1949 | Dann | 83/100 |
| 3,174,428 | 3/1965 | Huck | 101/227 |
| 3,194,095 | 7/1965 | Buck et al. | 83/100 |
| 3,380,327 | 4/1968 | Stemmler | 83/100 |
| 3,404,607 | 10/1968 | Feick et al. | 83/100 |
| 3,602,080 | 8/1971 | Sickel | 83/100 |
| 3,680,419 | 8/1972 | Stoop | 83/98 |
| 3,698,271 | 10/1972 | Kesten et al. | 83/99 |
| 3,698,272 | 10/1972 | Kesten et al. | 83/99 |
| 3,710,666 | 1/1973 | Keyes et al. | 83/99 |
| 3,766,814 | 10/1973 | Kesten | 83/99 |
| 3,872,752 | 3/1975 | Remde et al. | 83/100 |
| 4,037,501 | 7/1977 | Gladow | 83/100 |
| 4,191,077 | 3/1980 | Edwards et al. | 83/99 |
| 4,276,800 | 7/1981 | Koppa et al. | 83/863 |
| 4,409,870 | 10/1983 | Rynik et al. | 83/100 |

*Primary Examiner*—Frank T. Yost
*Assistant Examiner*—Hien H. Phan

[57] ABSTRACT

A die-cutting roll is constructed to cut holes in traveling web materials, and for clearing and discharging the fragments, in a highly effective manner. A multiplicity of air vent ports communicate with the channel through which the scrap moves to an internal axial passage of the roll, and supplement the effect of vacuum applied to one end thereof. Desirably, a disuniting effect is produced upon compacted formations strands of the removed material, by creating turbulence within the passage and/or by mechanical impact thereupon.

15 Claims, 11 Drawing Figures

ROTARY CUTTING DIES WITH VACUUM ASSIST TO CUT AND CLEAR WASTE

BACKGROUND OF THE INVENTION

It is commonplace to produce various items, such as labels, tags, tickets and the like, by die cutting them from traveling web stock, using a roll having a cutting element of appropriate configuration on its outer surface. Holes and openings can of course be produced in such a manner, but serious problems may arise as a result of the accumulation of scrap material within the die element; such accumulations will quickly render the roll ineffective, and may cause severe damage, such as bursting of the dies.

In an effort to avoid such problems, it is now quite common to employ hollow die-cutting rolls having channels extending between the cavity and the surface thereof within the confines of the cutting elements, with air charged into the roll cavity serving to eject the lodged pieces of scrap. Such air-eject rolls are disclosed, for example, in the following U.S. Pat. Nos. 3,698,271 and 3,698,272 to Kesten et al, 3,766,814 to Kesten, and 4,191,077 to Edwards et al., each of common assignment herewith. Although effective for their intended purposes, devices of the sort shown in these patents discharge the cut material outwardly, which may in certain instances entail less than optimal scrap management practices.

It has also been proposed to handle chips, slugs, confetti and the like, cut from web stock by rotary die cutting devices, by withdrawing the fragments into the cutting roll under vacuum, for direct discharge to a suitable container. Such systems are disclosed, for example, in U.S. Pat. Nos. 3,174,428 to Huck; 3,194,095 to Buck et al; 3,602,080 to Sickel; 3,680,419 to Stoop; and 4,037,501 to Gladow. Other U.S. Pat. Nos. of possible interest include the following:

Copland No. 705,040 discloses the use of vacuum and positive pressure for managing dough on a rotary cutting cylinder, and uses brushes to clean the surface of the die. A similar arrangement, for handling rubberized fabric strips, is shown is U.S. Pat. No. 1,825,250 to Rehak.

In Remde et al U.S. Pat. No. 3,872,752, apparatus is disclosed for cutting snack food dough, which uses a vacuum holding feature and also has positive pressure means for stripping purposes. Vacuum may be applied through passages which have a first zone parallel to the axis of the waste-removal drum in which they are contained, communicating with enlarged portions on the surface through several radially extending sections.

Koppa et al U.S. Pat. No. 4,276,800 describes a cutter for scoring dough sheets, and discloses a system using both vacuum and positive pressure, and employing multiple ports. Other forms of vacuum die rolls are shown in Stemmler U.S. Pat. Nos. 3,380,327 and Feick et al 3,404,607.

Despite the foregoing developments, a need remains for rotary die cutting apparatus which is effective for producing holes and other shapes in traveling web materials, which also functions to remove and dispose of the waste in an optimal, clean and efficient manner.

Accordingly, it is a primary object of the present invention to provide a novel rotary device, and a novel assembly utilizing the same, for cutting holes and other shapes in web materials, and for clearing the waste therefrom, which device operates at high speeds and produces a minimal amount of contamination.

It is also an object of the invention to provide such a device in which the effectiveness of scrap removal is such as to significantly reduce or virtually eliminate down-time required for cleaning material from the scrap exit path.

Another object of the invention is to provide a novel punching die insert adapted for mounting upon the exterior surface of a die cutting roll, and providing a secondary air-flow assist feature for promoting movement of scrap through associated channels of the roll body.

SUMMARY OF THE DISCLOSURE

It has now been found that certain of the foregoing and related objects of the invention are readily attained in a rotary device comprising a roll having an axial passage opening at least at one end, a multiplicity of generally radial channels extending from the passage to the exterior cylindrical surface thereof, and a corresponding multiplicity of die elements on the cylindrical surface adjacent the openings of associated channels, providing cutting edges thereabout configured for cutting waste fragments from the web material. The roll has a multiplicity of air vent ports, each extending from the cylindrical surface at a point adjacent the opening of an associated one of the channels and intersecting the associated channel inwardly thereof, to define inner and outer sections therein. As a result, air may be drawn through the ports to assist movement of waste fragments, removed from the web by the die elements, through the inner sections of the channels and into the axial passage of the roll.

In the preferred embodiments of the device, the roll will comprise a body, and a multiplicity of separate punching die inserts affixed thereto to provide the cutting elements thereon. The roll body substantially provides the cylindrical surface thereof, and has the inner portions of the radial channels formed therethrough and a multiplicity of recesses formed into the surface at the outer ends of the channel portions. The inserts are seated within the surface recesses, and each has an orifice providing communication between the cutting edge and the channel inner portion. The ports are advantageously formed in the punching die inserts, and most desirably two of them will be associated with each of the radial channels; generally, the ports will be substantially rectilinear and angled inwardly toward the associated channel from opposite sides of the opening thereof.

The roll will normally have shaft portions extending axially from its opposite ends, and the axial passage will open at both ends therethrough. One of the end portions will desirably be adapted to receive a coupling for attachment to a waste receptacle conduit, and the other end portion may be similarly adapted for attachment to a positive pressure supply source. In certain embodiments the axial passage will have a central portion larger in transverse cross-section than the opposite end portions thereof.

It may also be desirable to provide at least one auxiliary channel formed in the roll, to provide direct air flow communication from the exterior thereof into the axial passage, and thereby to enable an increased volume of air to flow through the roll. Such an auxiliary channel may most beneficially open on an exterior end surface of the roll at a location for intermittent registration, during rotation of the roll, with a positive air supply fixture mounted adjacent thereto.

Additional objects of the invention are attained by the provision of a die cutting roll assembly for use in a press, comprising a roll having the features hereinabove described, and waste breaker means assembled with the roll. The breaker unit will comprise a supporting member and an elongated breaker blade attached thereto, the supporting member being assembled with the roll adjacent the "one" end thereof for relative rotation therebetween, with the breaker blade extending longitudinally therefrom into the axial passage. The blade will also be of sufficient length to extend past the inner ends of the radial channels, and will be supported in a position displaced from the central axis of the roll toward the inner surface defining the passage thereof. Thus, as the roll rotates about the blade it will function to disunite formations of compacted waste fragments as they exit the channels of the roll.

The waste breaker blade may have a small bearing block or stub adjacent its free inner end, providing a surface for sliding contact upon the inner surface of the roll, the stub being of greater mass, per unit of length, than the blade to also dampen excessive movement thereof. In addition, the assembly may include a support block adapted for mounting in the press for rotatably supporting both the roll and also the supporting member of the breaker means. The support block and supporting member will advantageously have cooperating means thereon for adjusting and fixing the angular position of the breaker blade about the axis of the passageway, to thereby control the point of impact of the blade upon the waste exiting the channels. The supporting member means may more particularly, comprise a generally tubular union having means at one end for connection to a conduit and means at the other end for connection to the roll, to thereby enable communication to be established between the conduit and the axial passage. One end of the roll may be formed with a circumferential groove in the surface defining the passage, with the tubular union having a circumferential bead thereon dimensioned and configured to engage within the groove of the roll, to provide a relatively tight rotary connection therebetween. In addition, the tubular union may have a set of longitudinal threads extending partially thereabout, and the support block may carry an adjustment screw disposed to engage the threads of the union for rotating the same, to thereby enable control of the angular orientation of the breaker blade.

Further objects are provided by a punching die insert adapted for use in assembly with a die-cutting roll body having internal scrap removal passages. The insert will comprise a body having an orifice therethrough, a cutting element at one end of the orifice configured for cutting web material and removing a fragment therefrom, and at least one air bypass port extending from a point on the surface of the body, adjacent the cutting element, into intersection with the orifice at a point intermediate the ends thereof. The port will thereby define an outer section and an inner section in the orifice, and will permit air flow therethrough to assist movement of such web fragments through the inner section of the orifice. Generally, the orifice and cutting element of the punching die will be of a regular cross-sectional configuration about a central axis, and the insert will have two of such ports formed therein and disposed diametrically with respect to the axis. In some instances, the cross-section of the orifice and cutting element will be of flat-sided elliptical configuration, with the ports disposed either on the opposite sides of the ellipse or adjacent the opposite ends thereof.

DETAILED DESCRIPTION OF THE ILLUSTRATED EMBODIMENTS

Figure 1:
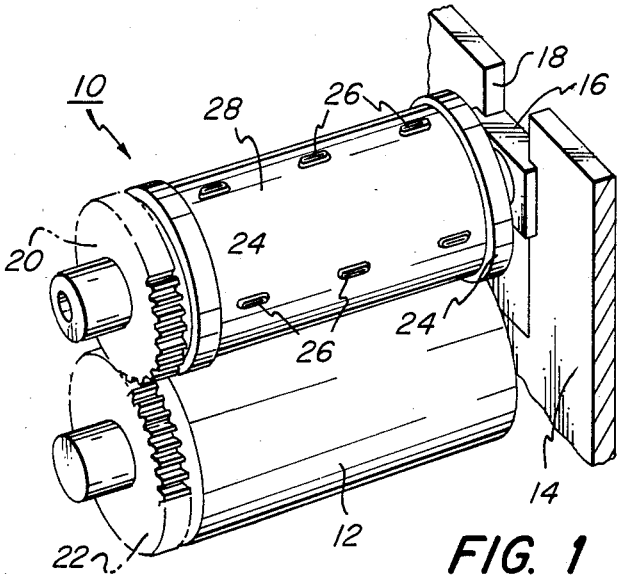
FIG. 1 is a diagrammatical, fragmentary perspective view showing a die-cutting roll embodying the present invention, assembled in a press with an underlying cooperating anvil roll.

Turning initially to FIG. 1 of the appended drawings, therein illustrated is a die-cutting roll embodying the invention, generally designated by the numeral 10, assembled with a cooperating underlying anvil roll 12 within the frame 14 of a press (only the structure on one side being shown, for clarity of illustration). The opposite ends of the roll 10 are journaled within bearing blocks 16 (again, only one being shown), which are in turn slidably engaged within the elongated slots 18 of the press frame 14. The cutting roll 10 and anvil 12 have attached gears 20, 22, respectively, which are in meshing engagement for synchronous rotation during operation of the machine, and a pair of annular bearers 24 adjacent the opposite ends of the cutting roll engage the surface of the anvil roll 12 to maintain suitable clearances; standard means for mounting and securing the assembly (not shown) will of course also be provided.

Figure 2:
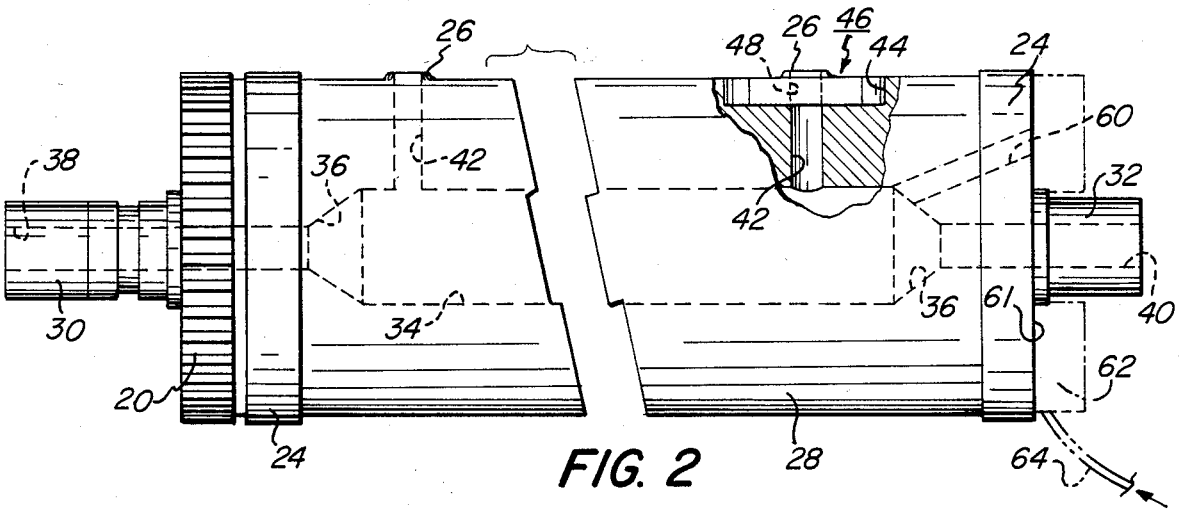
FIG. 2 is an elevational view of the die-cutting roll of FIG. 1, drawn to an enlarged scale, showing a portion of the body in section and a optional air ring fixture in phantom line.
Figure 3:
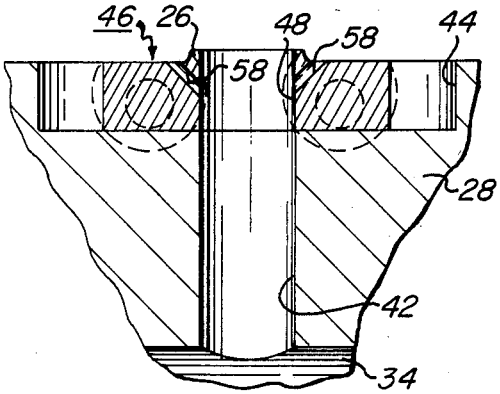
FIG. 3 is a further enlarged view of the sectional body portion depicted in FIG. 2.
Figure 4:
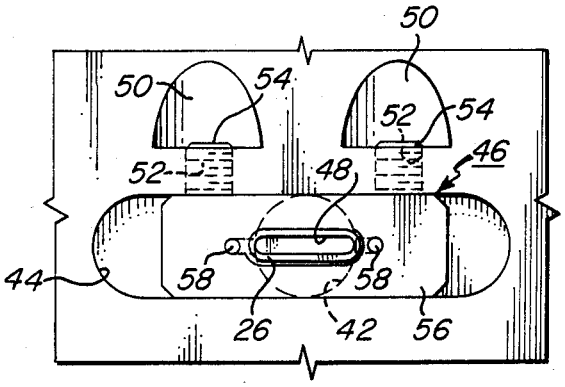
FIG. 4 is plan view showing the area of the roll surface corresponding to the section illustrated in FIG. 3 and drawn to the scale thereof.

The construction of the die-cutting roll 10 is shown in greater detail in FIGS. 2–4, from which it can be seen to include a generally cylindrical body 28, having shaft portions 30, 32 extending from its opposite ends and an axial passage extending therethrough. The passage includes a central portion or chamber 34 of relatively large diameter which tapers, through conical transition sections 36, to relatively small diameter sections 38, 40, passing respectively through the shaft portions 30, 32. A number of radial channels 42 extend, at axially and circumferentially spaced locations, through the wall of the body 28 between the chamber 34 and the surface of the roll, and connect at their outer ends with elongated recesses 44 formed into the cylindrical exterior surface of the body. (For clarity of illustration, the recesses are not shown in the roll of FIG. 1, and only two channels, with associated structure, are shown in FIG. 2).

Disposed within the recesses 44 are punching die inserts, generally designated by the numeral 46, each of which has an orifice or passage 48 therethrough and a cutting element 26 at the outer end of the orifice. The surface of the body 28 also has shallow channel formations 50 adjacent the recesses 44, to enable the insertion of set screws 54 into the threaded apertures 52, which extend therebetween; the set screws 54 are tightened upon the side of the insert body 45 to secure it in place.

Of particular importance to the proper functioning of the die cutting roll are the pair of ports 58 provided in the insert body 56. These ports extend from points closely adjacent the opposite ends of the straight-sided elliptical cutting elements 26, and angle inwardly (as best seen in FIG. 3) to intersect the orifice 48 intermediate its ends; the points of intersection may be regarded to define outer and inner sections of the orifice.

In operation, the elements 26 function to sever fragments from web material fed between the counter-rotating cutting roll 10 and anvil roll 12. These fragments enter the outer sections of the insert orifices 48, and are drawn inwardly under vacuum (through the channels 42 and the sections 34, 38 of the passage) applied from a suitable source connected by a conduit (neither of which is shown) to the shaft 30 of the roll 10. The vacuum will also cause air to flow at relative high velocity inwardly through the ports 58, producing a secondary assist upon the scrap fragments as they move past the port openings and into the inner sections of the orifices 48.

The configuration of the axial passage of the roll is designed to create a degree of turbulence, particularly within the enlarged chamber portion 34. This will tend to disunite any formations of fragments which may have become mechanically interconnected as a result of compaction at the entrance to and within the punching die insert 46, thereby further facilitating discharge of the scrap material.

The opposite end of the roll 10 may be open to the atmosphere through the passage section 40 to enhance air flow, or a source of positive pressure may be applied thereto to maximize scrap movement. An auxiliary channel 60 may also be formed through the roll body (see FIG. 2) to provide a direct path to the internal passage, to further increase the volumetric rate of air flow. It may be particularly desirable to associate with the roll, at a location directly against the end surface 61 at which the auxillary channel 60 opens, a ring-like (or similarly configured) fixture 62 for supplying air under pressure from hose 64 to the channel 60. Most desirably, the fixture will have one or more circularly spaced openings with which the end of the channel 60 may intermittently register as the roll 10 rotates, to produce a pulsating airstream for maximum effect upon the scrap formations.

Figure 5:
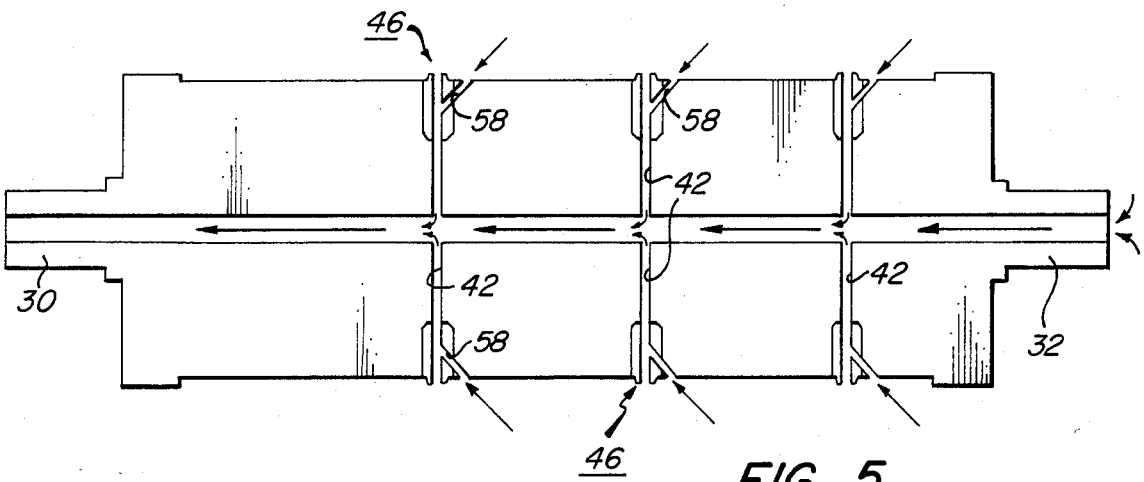
FIG. 5 is a schematic representation indicating paths of air flow through a typical die-cutting roll embodying the invention.

The gross flow of air through the form of the roll diagrammatically illustrated in FIG. 5 is as follows: air is withdrawn under vacuum through the axial shaft portion 30, and enters through the opposite shaft portion 32; it is simultaneously drawn through the radial channels 42 and the intersecting bypass ports 58. As suggested by the Figure, it is not essential that each of the channels have two associated ports 58, albeit that optimal air flow through the inner orifice section and the associated channel may be produced with such an arrangement.

Figure 6:
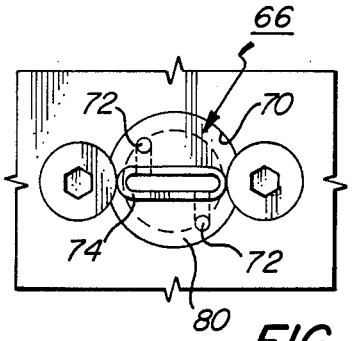
FIG. 6 is a plan view showing a second form of punching die insert suitable for use in assembly with a roll body to provide a rotary cutting device in accordance herewith.
Figure 8:
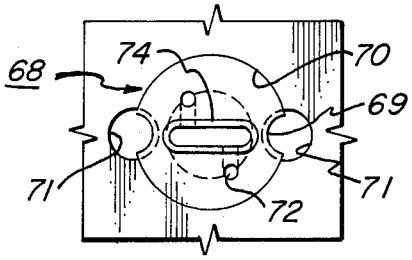
FIGS. 8 and 9 are, respectively, plan and sectional views similar to FIGS. 6 and 7, showing another embodiment of inserts.
Figure 7:
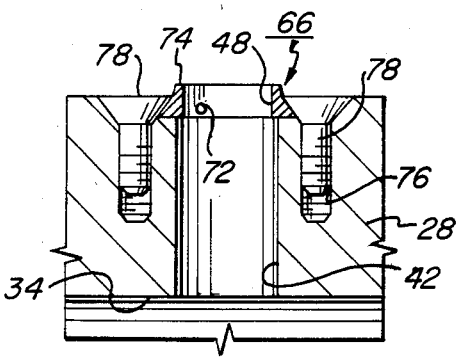
FIG. 7 is a sectional view showing the insert of FIG. 6 and the corresponding body portion.
Figure 9:
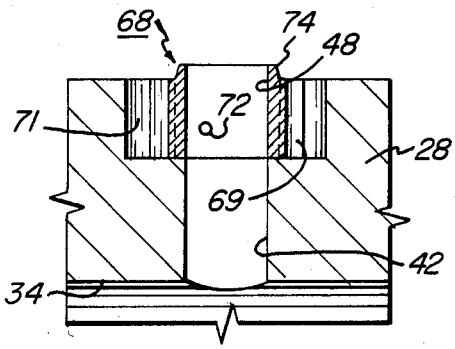

Alternative embodiments of punching die inserts and mounting means are shown in FIGS. 6–9, the insert of FIGS. 6 and 7 being generally designated by the numeral 66, and that of FIGS. 8 and 9 being generally designated by the numeral 68. It will be noted that in both instances the inserts, and the corresponding recesses 70, 72 in which they are seated, are of generally circular cross-section. It will also be noted that, unlike the ports 58 of the insert 46, which are disposed adjacent the ends of the cutting element 26, the ports 72 of the inserts 66, 68 are disposed at non-aligned positions along the opposite sides of the elements 74; this will tend to produce a different secondary air flow pattern, which may be advantageous in some instances. For assembly of the insert 66 within the recess 70, the body 28 of FIGS. 6 and 7 is provided with a pair of threaded apertures 76, which receive screws 78 having head portions bearing upon the flange portion 80 of the insert. The insert 68 is held in place by press fitting it into the corresponding recess 70; the body 28 is bored at 71 and the insert 68 is tapped at 69 to receive jacking screws, to enable facile removal of the insert, when desired.

Figure 10:
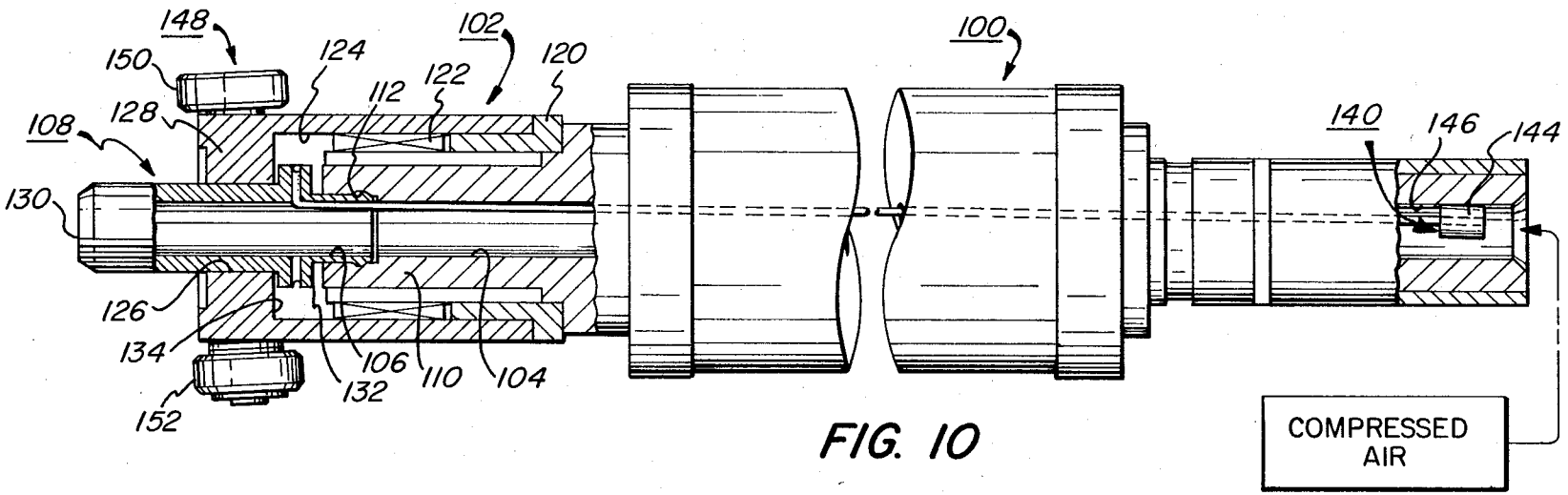
FIG. 10 is a fragmentary elevational view, in partial section, showing a die-cutting roll assembly embodying the invention, in which a waste breaker unit is assembled with the cutting roll.
Figure 11:
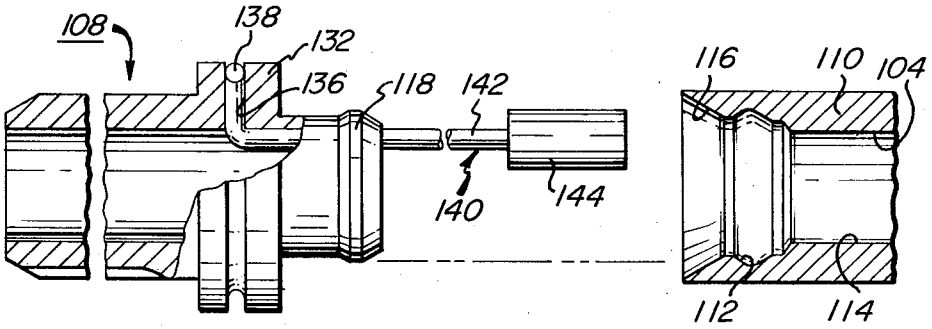
FIG. 11 is a fragmentary elevational view, in partial section, of the breaker unit and cooperating end portion of the roll used in the assembly of FIG. 10, drawn to a scale enlarged therefrom.

Turning finally to FIGS. 10 and 11 of the drawings, the assembly illustrated includes a die-cutting roll, generally designated by the numeral 100, and a support block, generally designated by the numeral 102, for mounting within the slot 18 of the press frame 14 (as suggested in FIG. 1). Although not shown, it will be understood that the roll 100 has a multiplicity of cutting elements and connecting channels for removal and delivery of web fragments to its axial passage 104 (similar to the structures illustrated and described hereinabove), which is of uniform diameter throughout its length and communicates with the bore 106 of a tubular nozzle, generally designated by the numeral 108, also supported within the block 102. As is best seen in FIG. 11, the end of the shaft portion 110 of the roll 100 has a circumferential groove 112 formed into its inner surface 114, and a tapered lead-in section 116. The adjacent end of the nozzle 108 has a correspondingly dimensioned and configured bead portion 118, which is engaged within the groove 112 in a snap-fit connection; thus, the structure of the shaft 110 and nozzle 108 afford a union which permits relative rotation of the roll 100 in the press, without substantial leakage of air through from the joint therebetween.

The shaft portion 110 of the roll 100 is received within a bushing 120 and bearing 122, both of which are fit into the circular bore portion 124 of the bearing block 102. An aperture 126 of lesser diameter is formed through the end wall 128 of the block, within which the outer end portion 130 of the nozzle 108 is engaged, the block 102 thereby providing secure support for it, as well.

A collar portion 132 is provided intermediate the ends of the nozzle 108, which bears upon the inner surface 134 of the end wall 128 and thereby prevents outward dissassembly from the block 102. The collar portion 132 also has a small, radially extending aperture, in which is engageably seated a short, right-angle foot element 138 of a waste-breaker sub-assembly, generally designated by the numeral 140.

The sub-assembly 140 consists of an elongated wire blade 142, bent to provide the foot element 138 and having a small stub or block 144 at its free outer end. The blade 142 is positioned to lie in close proximity to the inner surface 146 defining the passage 104 of the roll, and extends along substantially the entire length thereof. Consequently, strands or other mechanically integrated formations of scrap entering the passage from the several radial channels (not shown) will be impacted by the blade 142 as the roll 100 rotates thereabout, which will therefore effectively disunite such formations and thereby facilitate passage of the waste fragments through and from the cutting device. The stub 144 at the free end of the blade 142 provides not only a bearing element for contact with the inner surface 146 of the roll, to thereby reduce friction and wear, but also provides a concentrated mass (i.e., a large weight relative to the weight per unit of length of the blade) for damping movement and preventing any whipping action that might otherwise occur in the blade 142, which therefore tends to merely vibrate within the roll passage.

The assembly of FIGS. 10 and 11 also provides means for changing the angular orientation of the nozzle 108, and thereby for controlling the point of impact of the exiting scrap upon the blade 142, while the cutting roll is rotating within the operating press. Such means (more fully described in the above-cited Kesten et al and Kesten patents, in a related context) consists essentially of a threaded adjusting screw, generally designated by the numeral 148, having a knurled knob 150 at one end and a locking nut 152 at the opposite end. The adjacent portion of the nozzle 130 is longitudinally threaded or splined about a portion of its circumference, to permit meshing engagement with the threads of the screw 148, which is disposed at a slight oblique thereto. By turning the screw, the nozzle can be rotated through a limited arc, thereby changing the angular position of the blade 142 for impact upon the scrap; the nut 152 serves to lock the screw 148 against rotation, thereby preventing inadvertent change of attitude.

With final reference to FIG. 10, it will be noted that a source of compressed air 154 is diagrammatically illustrated. The air source is connected to the passage 104 through the shaft portion 156, and serves to augment the effect of applied vacuum (by permitting a greater than atmospheric pressure differential to be established), as discussed above in connection with the preceding Figures.

The details of construction of the die-cutting rolls of the invention may vary considerably, without departing from the scope of the appended claims. The cutting elements may take any of a multitude of shapes, and their disposition or distribution on the cylinder surface may deviate widely from those illustrated herein. The same is true of the number and location of the by-pass ports, although forming them within the punching die inserts is most advantageous, from the standpoint of convenience and economy of manufacture; nevertheless they might also be formed directly through the body of the roll, if so desired. The compound cross-sectional configuration of the roll passage, illustrated in FIG. 2, is advantageous from the standpoint of producing desirable turbulence in the airstream but, as is also clear from the drawings, this construction may vary; for example, particularly when a mechanical breaker unit is used, the passage may be of uniform diameter.

Thus, it can be seen that the present invention provides a rotary device, and assembly utilizing it, for cutting holes and other shapes in web materials, and for clearing the waste therefrom, which device operates at high speeds and produces a minimal amount of contamination. The effectiveness of the device makes it capable of significantly reducing or virtually eliminating downtime for cleaning accumulated material from the scrap exit path. The invention also provides a novel punching die insert adapted for mounting upon the exterior surface of a die cutting roll, providing a secondary air-flow assist feature for promoting movement of scrap through associated channels of the roll.

Having thus described the invention, what is claimed is:

1. A rotary device for cutting holes and other shapes in web materials, and for clearing the waste therefrom, comprising a roll having an axial passage opening at least at one end, and a multiplicity of generally radial channels extending from said passage to the exterior cylindrical surface thereof, a corresponding multiplicity of die elements on said cylindrical surface adjacent the outer openings of associated channels, providing cutting edges thereabout configured for cutting waste fragments from the web material, and a multiplicity of air vent ports, each of said ports extending from said cylindrical surface at a point adjacent the opening of an associated one of said channels and intersecting said associated channel inwardly thereof to define inner and outer sections therein, whereby air may be drawn through said ports to assist movement of waste fragments, removed from the web by said die elements, through the inner sections of said channels and into said axial passage of said roll.

2. The device of claim 1 wherein two of said air vent ports are associated with each of said radial channels, and wherein said ports are substantially rectilinear and are angled inwardly toward said associated channel from opposite sides of said opening thereof.

3. The device of claim 1 wherein said roll comprises a body which substantially provides said cylindrical surface, having the inner portions of said radial channels formed therethrough, and a multiplicity of recesses formed into said surface at the outer ends of said channel portions; and a multiplicity of separate punching die inserts seated within said surface recesses and affixed to said body to provide said cutting elements thereon, each of said inserts having an passageway therethrough providing communication between said cutting edge and said channel inner portion.

4. The device of claim 3 wherein said ports are formed in said punching die inserts.

5. The device of claim 4 wherein two of said air vent ports are associated with each of said radial channels, and wherein said ports are substantially rectilinear and are angled inwardly toward said associated channel from opposite sides of said opening thereof.

6. The device of claim 1 wherein said roll has shaft portions extending axially from the opposite thereof, and wherein said axial passage opens at both of opposite ends through said shaft portions.

7. The device of claim 6 wherein said axial passage has a central portion larger in transverse cross-section than the opposite end portions thereof.

8. The device of claim 6 wherein one of said shaft portions is adapted to receive a coupling, and wherein said device additionally includes a coupling attached thereto.

9. The device of claim 8 additionally including a positive pressure supply source connected to said axial passage through the other shaft portion of said roll.

10. The device of claim 1 wherein at least one auxiliary channel is formed in said roll to provide direct air flow communication from the exterior thereof into said axial passage, to enable an increased volume of air to flow through said roll.

11. The device of claim 10 wherein said auxiliary channel opens on an exterior end surface of said roll at a location for intermittent registration, during rotation of said roll, with a positive air supply fixture mounted adjacent thereto.

12. A punching die insert for use in assembly with a die-cutting roll body having internal scrap removal passages, comprising a body having a passageway with two ends therethrough, a cutting element at one end of said passageway configured for cutting web material and removing a fragment therefrom, and at least one air bypass port extending from a point on the surface of said body adjacent said cutting element into intersection with said passageway at a point intermediate said ends thereof, said port thereby defining an outer section and an inner section in said passageway, and permitting air flow therethrough to assist movement of such web fragments through said inner section thereof.

13. The insert of claim 12 wherein said passageway and cutting element are of a regular cross-sectional configuration about a central axis, and wherein said insert has two of said ports formed therein, disposed diametrically with respect to said axis.

14. The insert of claim 13 wherein said cross-section is of flat-sided elliptical configuration, and wherein said ports are disposed on opposite sides of the ellipse.

15. The insert of claim 13 wherein said cross-section is of flat-sided elliptical configuration, and wherein said ports are disposed adjacent the opposite ends of the ellipse.

* * * * *

UNITED STATES PATENT AND TRADEMARK OFFICE

CERTIFICATE OF CORRECTION

PATENT NO. : 4,599,926

DATED : July 15, 1986

INVENTOR(S) : Leroy H. Carlson, Jr. and Martin Kesten

It is certified that error appears in the above-identified patent and that said Letters Patent are hereby corrected as shown below:

Claim 1, line 29, "outer" omitted before "opening".

Claim 6, line 61, "ends" omitted before "thereof".

Signed and Sealed this

Ninth Day of December, 1986

*Attest:*

DONALD J. QUIGG

*Attesting Officer*

*Commissioner of Patents and Trademarks*